US009251752B2

(12) United States Patent
Seo et al.

(10) Patent No.: US 9,251,752 B2
(45) Date of Patent: Feb. 2, 2016

(54) GAMMA COMPENSATION METHOD AND DISPLAY DEVICE USING THE SAME

(71) Applicant: LG DISPLAY CO., LTD., Seoul (KR)

(72) Inventors: Woongjin Seo, Daegu (KR); Moojong Lim, Seoul (KR); Jaehong Kim, Paju-si (KR); Junwoo Jang, Goyang-si (KR); Taeyong Park, Paju-si (KR); Seonmee Lee, Gangwon-do (KR); Taeuk Kim, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 6 days.

(21) Appl. No.: 14/261,926

(22) Filed: Apr. 25, 2014

(65) Prior Publication Data

US 2014/0320552 A1 Oct. 30, 2014

(30) Foreign Application Priority Data

Apr. 25, 2013 (KR) ..... 10-2013-0046064
Mar. 31, 2014 (KR) ..... 10-2014-0037687

(51) Int. Cl.

| | |
|---|---|
| ***G09G 3/36*** | (2006.01) |
| ***G09G 3/20*** | (2006.01) |
| *G09G 3/32* | (2006.01) |
| *G09G 3/34* | (2006.01) |

(52) U.S. Cl.

CPC ..... *G09G 3/3648* (2013.01); *G09G 3/20* (2013.01); *G09G 3/3233* (2013.01); *G09G 3/3406* (2013.01); *G09G 2320/064* (2013.01); *G09G 2320/0606* (2013.01); *G09G 2320/0673* (2013.01); *G09G 2354/00* (2013.01); *G09G 2360/144* (2013.01); *G09G 2360/16* (2013.01)

(58) Field of Classification Search

CPC ..... G09G 3/28; G09G 3/2803; G09G 3/30; G09G 3/32; G09G 3/3208; G09G 3/36; G09G 2320/0276; G09G 2360/144
USPC ..... 345/60–72, 76–83, 87–104
See application file for complete search history.

(56) References Cited

U.S. PATENT DOCUMENTS

| | | | | |
|---|---|---|---|---|
| 8,473,871 | B1 * | 6/2013 | Sandler et al. | 715/863 |
| 2002/0054035 | A1 * | 5/2002 | Nitta | 345/204 |
| 2006/0268299 | A1 * | 11/2006 | Nose et al. | 358/1.9 |
| 2007/0081721 | A1 * | 4/2007 | Xiao et al. | 382/167 |
| 2007/0236431 | A1 * | 10/2007 | Tada | G09G 3/3208 345/84 |
| 2007/0286533 | A1 * | 12/2007 | Harada | 382/309 |
| 2008/0204378 | A1 * | 8/2008 | Park et al. | 345/77 |
| 2009/0324070 | A1 * | 12/2009 | Hayashi | 382/165 |

(Continued)

*Primary Examiner* — Vijay Shankar
*Assistant Examiner* — Nelson Lam
(74) *Attorney, Agent, or Firm* — Dentons US LLP

(57) ABSTRACT

A gamma compensation method and a display device using the same are disclosed. The gamma compensation method includes: sensing a level of external illuminance; determining whether the sensed level of external illuminance is equal to or lower than a predetermined illuminance, wherein when the sensed level is equal to or lower than the predetermined illuminance, the luminance of the display device is reduced to an optimum luminance; and modulating gray levels of input data of the display device based on a first gamma curve when the sensed level of external illuminance is equal to or lower than the predetermined illuminance, and modulating based on a second gamma curve when the sensed level of external illuminance is greater than the predetermined illuminance, wherein the first gamma curve includes a concave curve set in a low gray level area and a convex curve set in a high gray level area, and the concave curve and the convex curve are connected via an inflection point.

19 Claims, 16 Drawing Sheets

(56) References Cited

U.S. PATENT DOCUMENTS

2010/0039455 A1* 2/2010 Ahn ..... 345/690
2010/0053195 A1* 3/2010 Harada et al. ..... 345/589
2010/0066769 A1* 3/2010 Nose ..... G09G 3/3648 345/690
2010/0123731 A1* 5/2010 Morimoto ..... 345/589
2010/0165002 A1* 7/2010 Ahn ..... 345/690
2010/0254623 A1* 10/2010 Yu et al. ..... 382/274
2010/0321415 A1* 12/2010 Cho ..... G09G 3/2014 345/690

* cited by examiner

| | a | α | β |
|---|---|---|---|
| ----—·—·—---- | 128 | 3.0 | 3.0 |
| ····· | 112 | 3.0 | 3.0 |
| —-—-— | 96 | 3.0 | 3.0 |
| ——— | 80 | 3.0 | 3.0 |

| | a | α | β |
|---|---|---|---|
| ----------- | 96 | 3.0 | 3.0 |
| ..... | 96 | 3.5 | 2.5 |
| — - — - — | 96 | 4.0 | 2.0 |
| ———— | 96 | 4.5 | 3.5 |

| Age (years) | Photopic pupil diameter (mm) | Scotopic pupil diameter (mm) |
|---|---|---|
| 20 | 5.0 | 8.0 |
| 40 | 4.0 | 6.0 |
| 50 | 3.5 | 5.5 |
| 60 | 3.0 | 4.25 |
| 70 | 2.5 | 3.0 |

GAMMA COMPENSATION METHOD AND DISPLAY DEVICE USING THE SAME

This application claims the benefit of Korean Patent Application No. 10-2013-0046064 filed on Apr. 25, 2013, and Korean Patent Application No. 10-2014-0037687 filed on Mar. 31, 2014, the entire contents of which are incorporated herein by reference for all purposes as if fully set forth herein.

BACKGROUND OF THE INVENTION

1. Field of the Invention

The present invention relates to a gamma compensation method and a display device using the same.

2. Discussion of the Related Art

When a user watches an image having a high luminance that is displayed on a display device in a dark watching environment (for example, a low illuminance) for a long time, eye fatigue of the user may increase because of the glare of the image and the user may feel a reduction in concentration.

Hand devices such as mobile phones and tablet computers have an automatic brightness control (ABC) function which senses an illuminance of an external environment using an illuminance sensor and adjusts a luminance of a display panel. The ABC function reduces the luminance of the display panel at a low illuminance. When the luminance of the display panel is reduced to the low illuminance, the grayscale representation, particularly, the representation of low gray levels may be reduced. This is because the gamma compensation characteristic of the display device is determined a conventional 2.2 gamma curve, which defines a luminance of each gray level of the display device, irrespective of an external illuminance.

SUMMARY OF THE INVENTION

Accordingly, the present invention is directed to a gamma compensation method and a display device using the same capable of preventing a reduction in image quality when a luminance of a display panel is reduced.

Additional features and advantages of the invention will be set forth in the description which follows, and part will be apparent from the description, or may be learned by practice of the invention. These and other advantages of the invention will be realized and attained by the method and structure particularly pointed out in the written description and claims here of as well as the appended drawings.

To achieve these and other advantages and in accordance with the purpose of the present invention, as embodied and broadly described, a gamma compensation method for a display device, comprises: sensing a level of external illuminance; determining whether the sensed level of external illuminance is equal to or lower than a predetermined illuminance, wherein when the sensed level is equal to or lower than the predetermined illuminance, the luminance of the display device is reduced to an optimum luminance; and modulating gray levels of input data of the display device based on a first gamma curve when the sensed level of external illuminance is equal to or lower than the predetermined illuminance, and modulating based on a second gamma curve when the sensed level of external illuminance is greater than the predetermined illuminance, wherein the first gamma curve includes a concave curve set in a low gray level area and a convex curve set in a high gray level area, and the concave curve and the convex curve are connected via an inflection point.

In another aspect of the present invention, a display device comprises: a display panel driver arranged to modulate gray levels of input image data, which will be written to pixels of a display panel, based on a first gamma curve when a luminance of a display panel is reduced to be equal to or less than a previously determined optimum luminance, and modulate the gray levels of input image data based upon a second gamma curve when the luminance of the display panel is greater than the optimum luminance, wherein the first gamma curve includes a concave curve set in a low gray level area and a convex curve set in a high gray level area, and the concave curve and the convex curve are connected via an inflection point.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

A display device according to an exemplary embodiment of the invention may be implemented as a flat panel display such as a liquid crystal display (LCD), a field emission display (FED), a plasma display panel (PDP), and an organic light emitting display (sometimes called "organic light emitting diode (OLED) display"). The display device may be connected to an illuminance sensor for sensing an external illuminance in real time and a camera. The external illuminance means an illuminance of an external environment, in which the display device is used.

In the following embodiments of the invention, a luminance of a display panel means a luminance of the display panel which automatically changes or manually changes through a user's operation depending on the external illuminance of the display device. It is a matter of course that the luminance of the display panel changes based on a gamma curve when a gray level of input image data changes. However, the luminance of the display panel described in the following embodiments of the invention does not indicate a luminance that changes over time depending on the gray level of the input image data, but, instead, a luminance that changes depending on the external illuminance or through the user's operation.

The gamma curve is defined by the luminance of the display panel at each gray level of an input image. In the following embodiments of the invention, the gamma curve is divided into S gamma curve (or a first gamma curve) and 2.2 gamma curve (or a second gamma curve). The 2.2 gamma curve is an existing gamma characteristic curve, which has been used in display panels of all display devices currently on the market, and is expressed by Equation (1) below. The S gamma curve is a new gamma curve proposed by the embodiments of the invention and is a gamma characteristic curve capable of improving power consumption while minimizing a reduction in image quality which a user feels at a low illuminance. The S gamma curve is expressed by the below Equations (2) to (5).

Reference will now be made in detail to embodiments of the invention, examples of which are illustrated in the accompanying drawings. Wherever possible, the same reference numbers will be used throughout the drawings to refer to the same or like parts.

Figure 1:
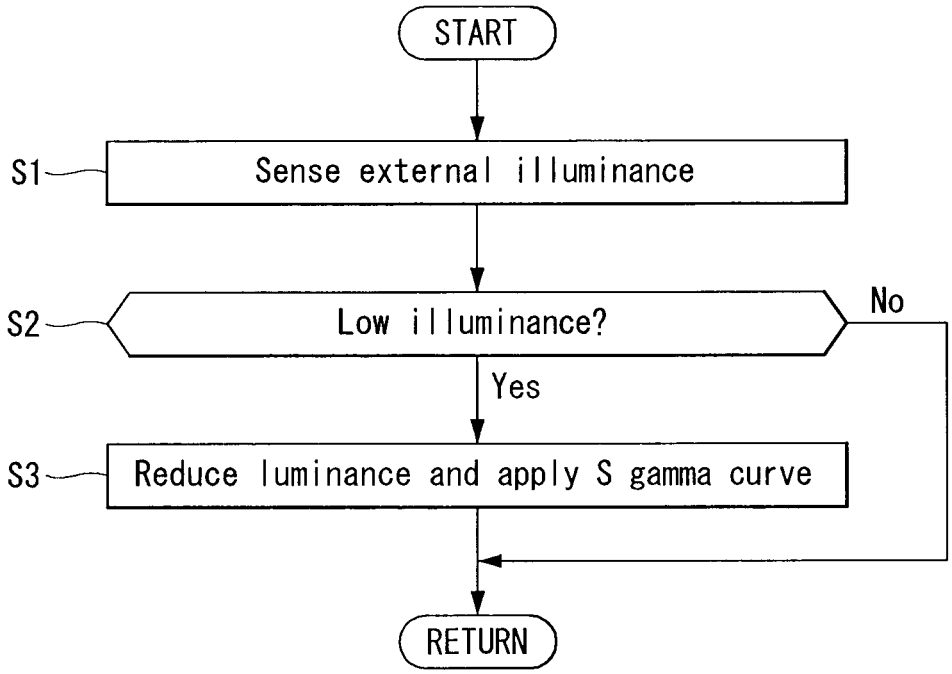
FIG. 1 is a flow chart showing a gamma compensation method according to a first embodiment of the invention.

As shown in FIG. 1, a gamma compensation method according to a first embodiment of the invention senses an illuminance (hereinafter referred to as "external illuminance") of an external environment in step S1. When the external illuminance is a low illuminance, the gamma compensation method according to the first embodiment of the invention reduces a luminance of a display panel to improve power consumption and changes a gamma compensation method so as to prevent a reduction in image quality resulting from a reduction in the luminance of the display panel.

The low illuminance is an illuminance (for example, a value equal to or less than about 100 lx) in very cloudy weather. An optimum luminance is a luminance of the display panel, at which a user does not feel eye fatigue and can comfortably watch an image displayed on a display device. A minimum recognition luminance is a minimum luminance of the display device, at which it is difficult for the user to recognize a difference between gray levels of the image. The minimum recognition luminance may be determined through an experiment conducted based on older people with poor eyesight.

The minimum recognition luminance is less than the optimum luminance and is greater than 0 (zero) cd/m$^2$. When the luminance of the display panel is greater than the optimum luminance, the user may feel eye fatigue or experience glare. When the luminance of the display panel is less than the minimum recognition luminance, it is difficult for the user to recognize a difference between gray levels of the image. The optimum luminance and the minimum recognition luminance may vary depending on the type of display device or characteristics of the display panel. The low illuminance may include a illuminance, (for example, about 100 lx) in very cloudy weather, an illuminance (for example, about 50 lx) in a dark living room, and an illuminance (for example, about 0 (zero) lx) in a darkroom. Optimum luminances and minimum recognition luminances at the above low illuminances are as follows.

Optimum luminance at about 100 lx>optimum luminance at about 50 lx>optimum luminance at about 0 lx.

Minimum recognition luminance at about 100 lx>minimum recognition luminance at about 50 lx>minimum recognition luminance at about 0 lx.

S-curve gamma compensation method modulates gray levels of input data based on S-shaped curve (hereinafter referred to as "S gamma curve"). The gamma compensation method according to the embodiment of the invention modulates gray levels of input data based on an existing 2.2 gamma curve when the external illuminance is a high illuminance.

A method for reducing the luminance of the display panel may use a method for reducing a luminance of a backlight unit in the liquid crystal display. In a plasma display panel, for example, a luminance of pixels may be reduced by reducing the number of sustain pulses. In a field emission display, for example, a luminance of pixels may be reduced by reducing an anode voltage. In a organic light emitting display, for example, a luminance of pixels may be reduced by reducing a high potential power voltage ELVDD applied to the pixels.

Another method for reducing the luminance of the display panel reduces a gamma reference voltage in a data driving circuit of the display device, to which the gamma reference voltage is supplied, thereby reducing the luminance of the pixels. The gamma reference voltage is divided into gamma compensation voltages in the data driving circuit. The data driving circuit converts digital data into the gamma compensation voltages and outputs the gamma compensation voltages to data lines.

When the external illuminance is the low illuminance, the gamma compensation method according to an embodiment of the invention reduces the luminance of the display panel to be equal to or less than a previously determined optimum luminance, thereby reducing the power consumption. At the same time, the gamma compensation method according to the embodiment of the invention applies the S-curve gamma compensation method in steps S2 and S3, so as to prevent a reduction in the grayscale representation caused when the luminance of the display panel is reduced. As shown in FIGS. 2 to 6, the S-curve gamma compensation method compensates for gamma characteristics of the display image along S-shaped gamma curve, i.e., S gamma curve. The S gamma curve has a luminance value greater than the 2.2 gamma curve at the low gray level and at the high gray level.

The optimum luminance is the luminance of the display panel applied when the external illuminance is the low illuminance. The optimum luminance may be set to a value capable of reducing an increase in the user's eye fatigue through an experiment. According to the result of the experiment conducted for the present invention, when the external illuminance is reduced to a level of a darkroom, the optimum luminance capable of reducing an increase in the user's eye fatigue may be 6.5 nit (=cd/m$^2$) to 25 nit (=cd/m$^2$). A recognition optimum luminance increases as a brightness of the image displayed on the display device decreases. However, the recognition optimum luminance is scarcely affected by the brightness of an image, of which an average picture level (APL) is equal to or greater than 30. The gamma compensation method according to the embodiment of the invention may reduce the luminance of the display panel to the optimum luminance when the external illuminance is the low illuminance, or adjust the luminance of the display panel to a luminance less than the optimum luminance so as to further reduce the power consumption.

Figure 2:
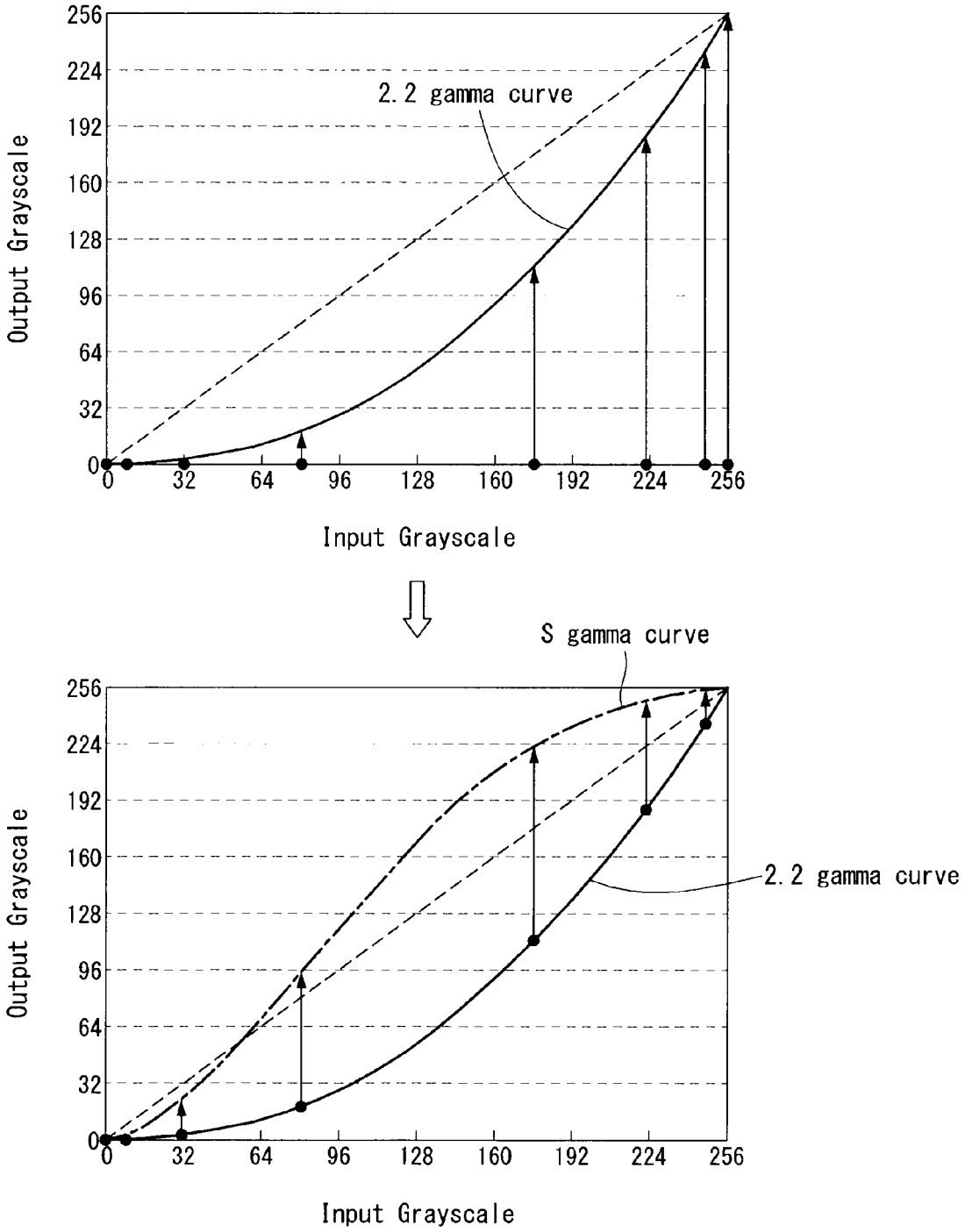
FIG. 2 shows a 2.2 gamma curve and S gamma curve.
Figure 3:
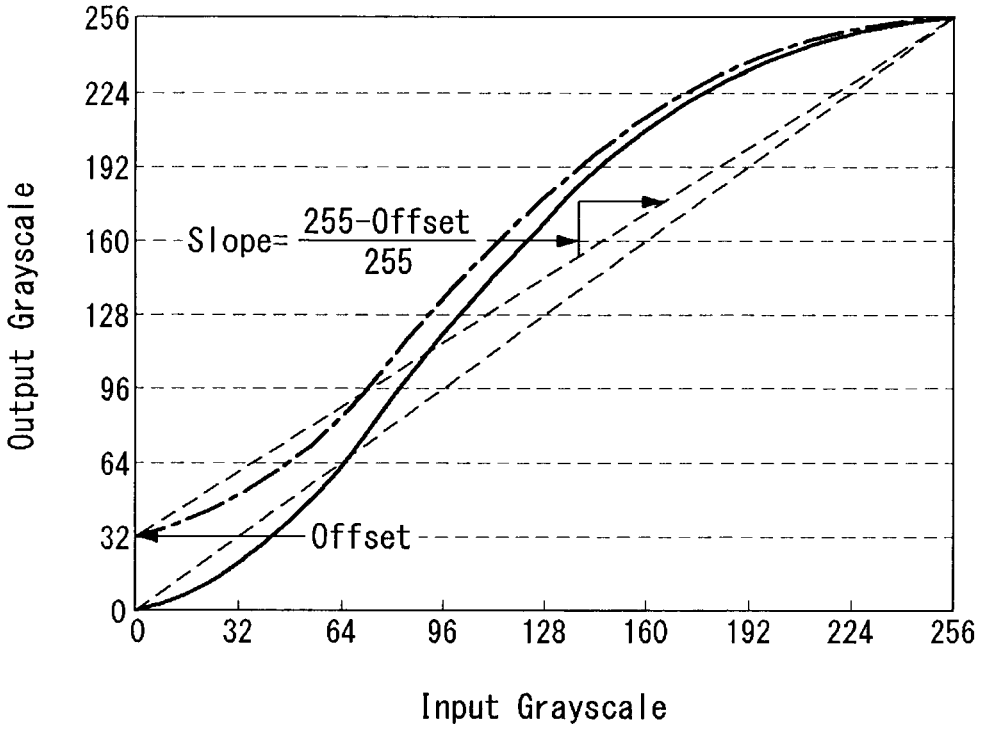
FIG. 3 shows an example of applying an offset to a S gamma curve.

FIG. 2 shows a 2.2 gamma curve and a S gamma curve. FIG. 3 shows an example of applying an offset to a S gamma curve. FIGS. 4 to 8 show examples of changing a parameter of a S gamma curve.

As shown in FIGS. 2 and 3, the 2.2 gamma curve applied to a general gamma compensation method is defined by the Equation (1). In Equation (1), '$D_{in}$' is data of an input image, and '$D_{out}$' is output data set along the 2.2 gamma curve. The output data $D_{out}$ is data which will be written on pixels of the display panel. The 2.2 gamma curve may be implemented by a first lookup table. The first lookup table outputs the output data $D_{out}$ corresponding to the input data $D_{in}$ based on input/output gray levels defined along the 2.2 gamma curve, thereby modulating the input data $D_{in}$.

$$D_{out} = 255 \cdot \left(\frac{D_{in}}{255}\right)^{2.2} \tag{1}$$

As shown in FIG. 2, a slope of the 2.2 gamma curve is low at the low gray level. Thus, when the luminance of the display panel decreases, a difference between the low gray levels is not recognized. Therefore, the representation of the low gray levels is not good. Hence, the gamma compensation method according to the embodiment of the invention modulates data Din of the input image based on the S gamma curve as indicated by the Equation (2) and the lower diagram of FIG. 2, so as to prevent a reduction in the grayscale representation when the luminance of the display panel is reduced depending on the external illuminance or is compulsively reduced by the user. The S gamma curve may include a concave curve defining input/output gray levels in a low gray level area (0≤Din≤a) and a convex curve defining input/output gray levels in a high gray level area (a≤Din≤255). The concave curve and the convex curve are connected via an inflection point 'a'. The S gamma curve may be implemented by a second lookup table. The second lookup table outputs the output data $D_{out}$ corresponding to the input data $D_{in}$ based on input/output gray levels defined along the S gamma curve, thereby modulating the input data $D_{in}$.

$$D_{out} = \begin{cases} a^{(1-\alpha)} D_{in}^{\alpha}, & 0 \le D_{in} \le a \\ 255 - (255 - a)^{(1-\beta)}(255 - D_{in})^{\beta}, & a < D_{in} \le 255 \end{cases} \tag{2}$$

In Equation (2), 'a' is the inflection point between the concave curve and the convex curve, 'α (alpha)' is an emphasis variable of the low gray level, and β (beta)' is an emphasis variable of the high gray level.

The S gamma curve has a slope greater than the 2.2 gamma curve at the low gray level, thereby increasing the representation of the low gray level and increasing a luminance of the high gray level. As shown in FIG. 3, the S gamma curve may increase the low gray level by a predetermined offset.

The embodiment of the invention increases a luminance of the low gray levels using the S gamma curve shown in FIG. 3, thereby further improving the visibility of the low gray levels. Further, brightness and a contrast ratio of the low gray levels may be generally maintained. FIG. 3 shows an example of setting an offset value to 32. When the S gamma curve is shifted by the offset value, a minimum gray level is modulated to a gray level greater than zero. The S gamma curve, to which the offset value is applied, is defined by the following Equation (3). When the low gray levels of the S gamma curve is increased by a predetermined offset value and a maximum gray level of the S gamma curve is fixed, a slope 'S' of the S gamma curve is reduced.

$$D_{out} = \begin{cases} S \cdot a^{(1-\alpha)} D_{in}^{\alpha} + O, & 0 \le D_{in} \le a \\ S \cdot (255 - (255 - a)^{(1-\beta)}(255 - D_{in})^{\beta}) + O, & a < D_{in} \le 255 \end{cases} \tag{3}$$

In Equation (3), 'S' is the slope, and 'O' is the offset.

In FIGS. 2 to 5, a horizontal axis (or x-axis) is the gray level of the input data, and a vertical axis (or y-axis) is the gray level of the output data. In FIGS. 6 to 11, a horizontal axis (or x-axis) is the gray level of the input data, and a vertical axis (or y-axis) is the luminance.

Figure 4:
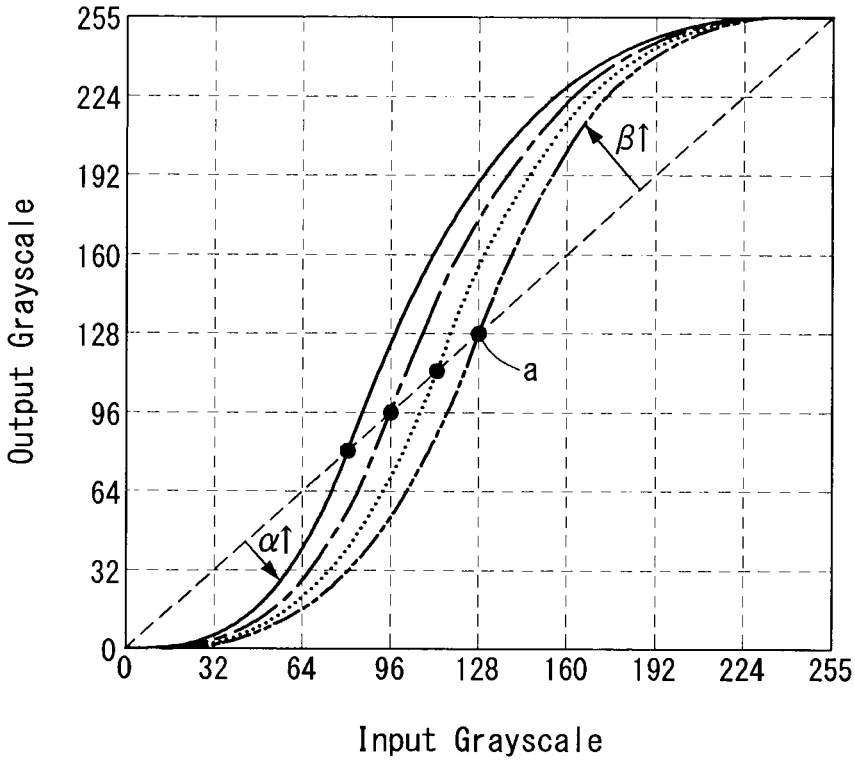
FIGS. 4 to 8 show examples of changing a parameter of a S gamma curve.
Figure 5:
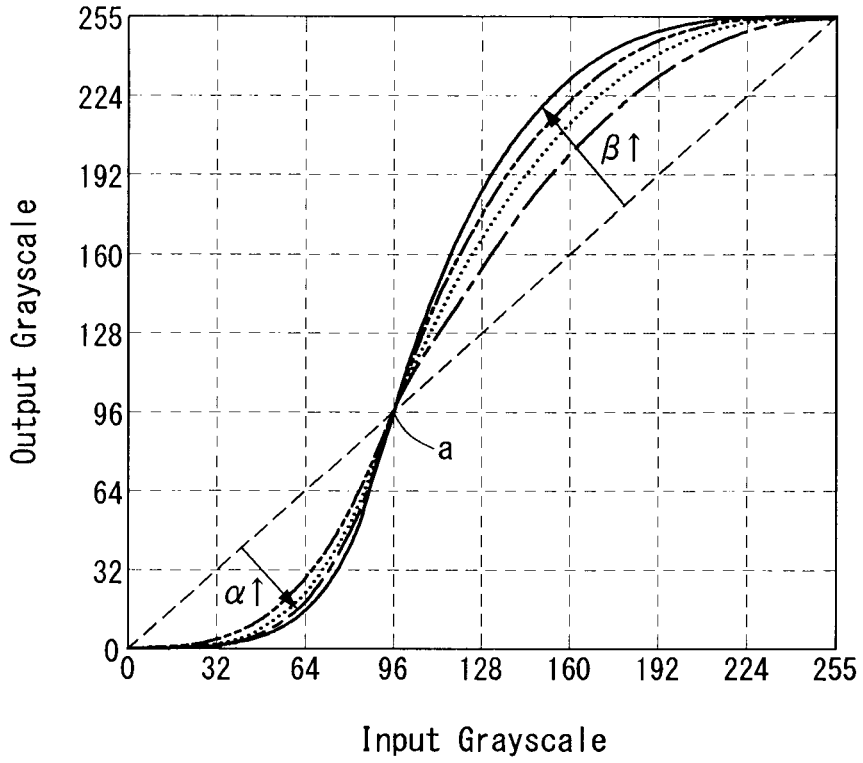
Figure 6:
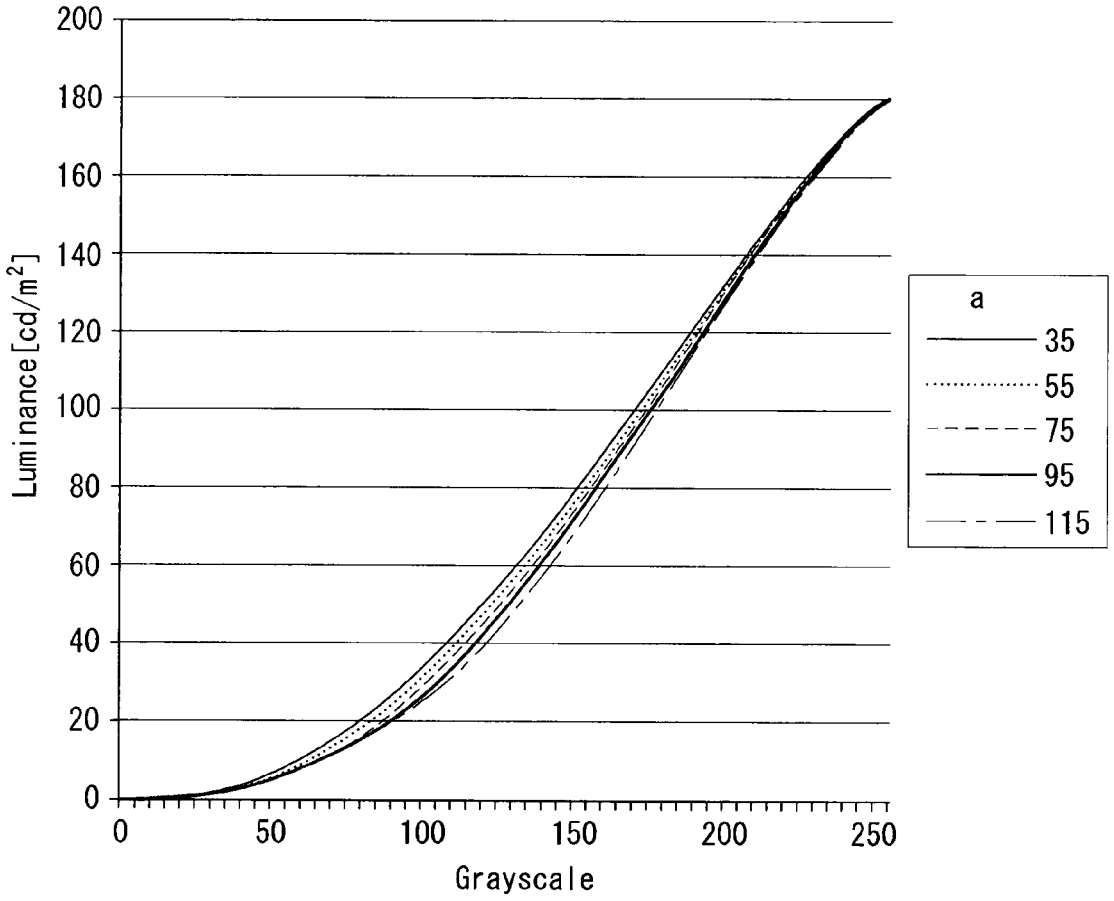
Figure 7:
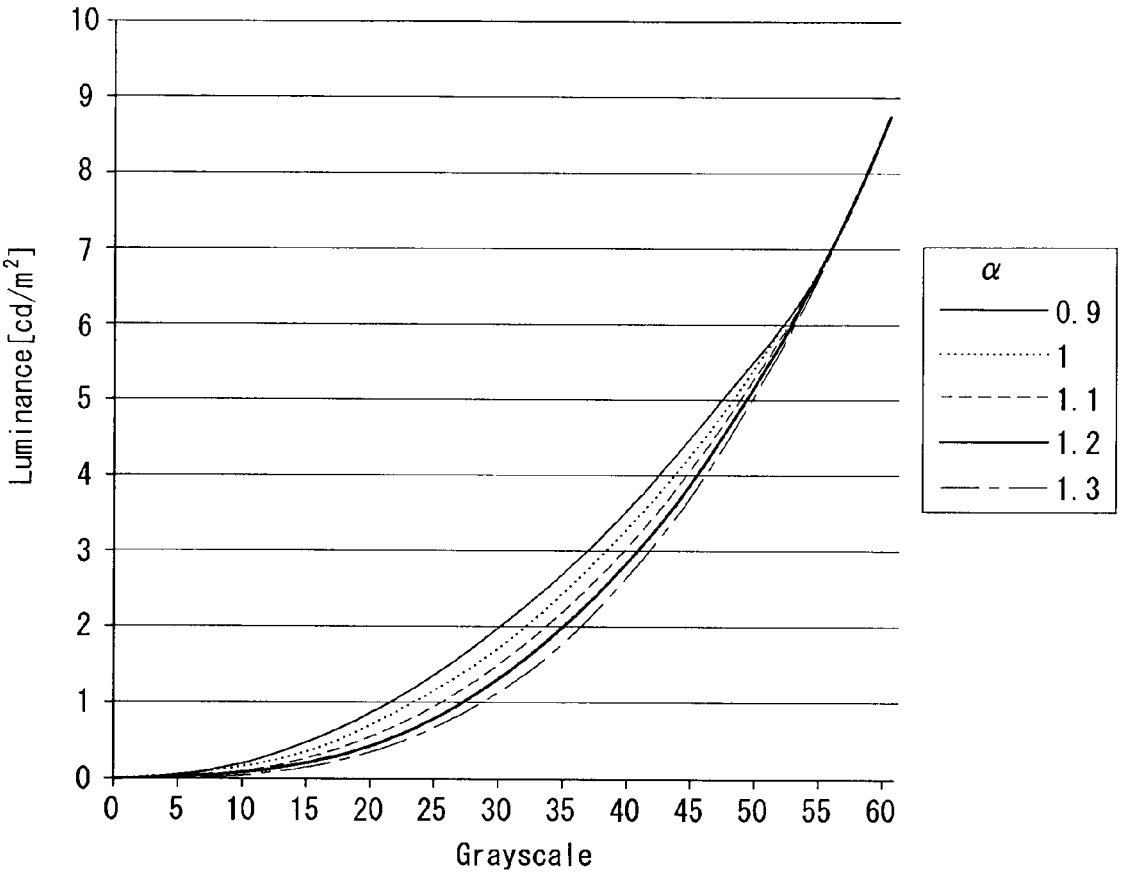
Figure 8:
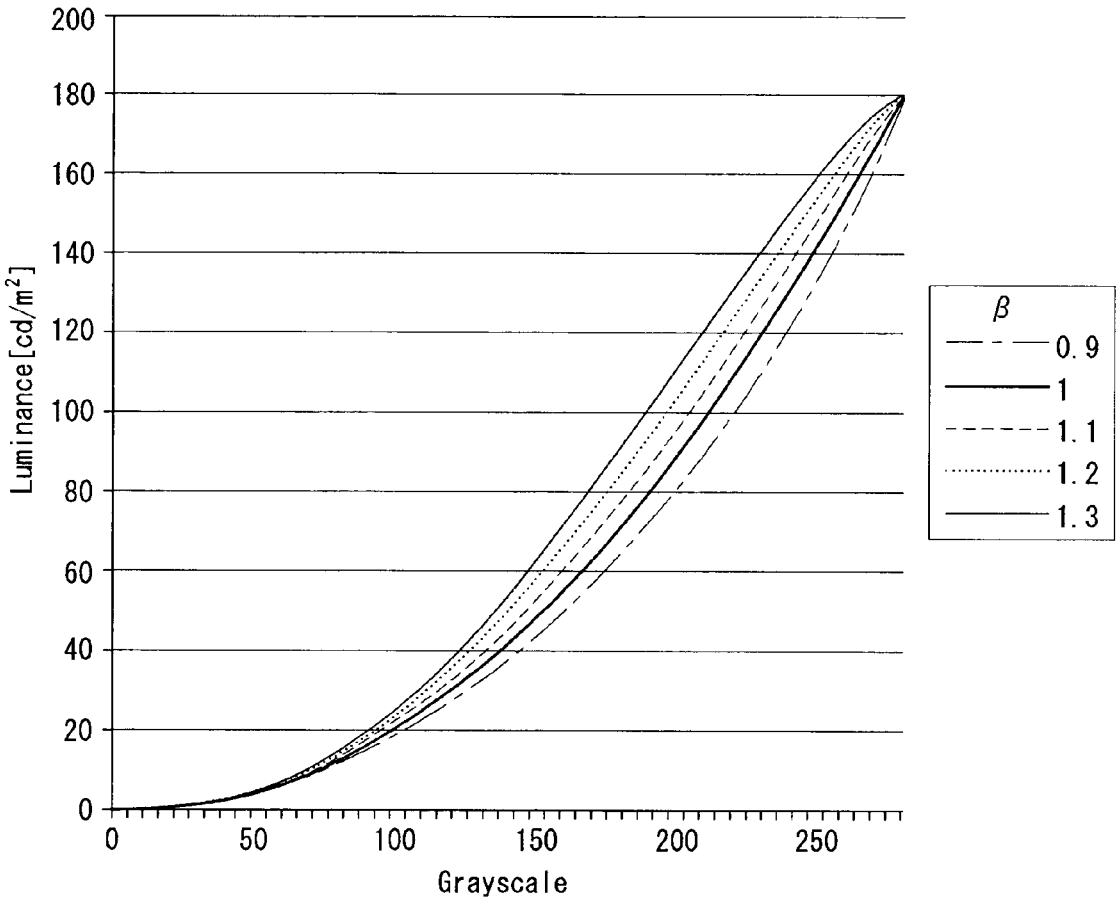

As shown in FIGS. 4 to 8, the S gamma curve varies depending on the variables a, a, and β. When the inflection point 'a' varies, occupation percentages of the concave curve and the convex curve based on the S gamma curve are changed. For example, as shown in FIGS. 4 and 6, as a position of the inflection point 'a' rises, the occupation percentage of the concave curve increases, and the occupation percentage of the convex curve decreases. When the low gray level emphasis variable 'α' varies, the curvature of the concave curve is changed. As shown in FIGS. 5 and 7, as the low gray level emphasis variable 'α' increases, the concave curve is more concavely changed. The low gray level emphasis variable 'α' affects the representation and the contrast ratio of the low gray levels. When the high gray level emphasis variable 'β' varies, the curvature of the convex curve is changed. As shown in FIGS. 5 and 8, as the high gray level emphasis variable 'β' increases, the convex curve is more convexly changed. The high gray level emphasis variable 'β' affects the representation and the luminance of the high gray levels.

The variables a, α, and β of the S gamma curve may be optimized in consideration of the luminance of the display panel, the external illuminance, the user's age, etc. The variables a, α, and β of the S gamma curve may be fixed to specific values and may vary depending on the luminance of the display panel, the external illuminance, the user's age, etc. The luminance of the display panel may be calculated using a luminance of the backlight unit or the Average Picture Level (APL). The external illuminance and the user's age may be sensed through a sensor.

Figure 9:
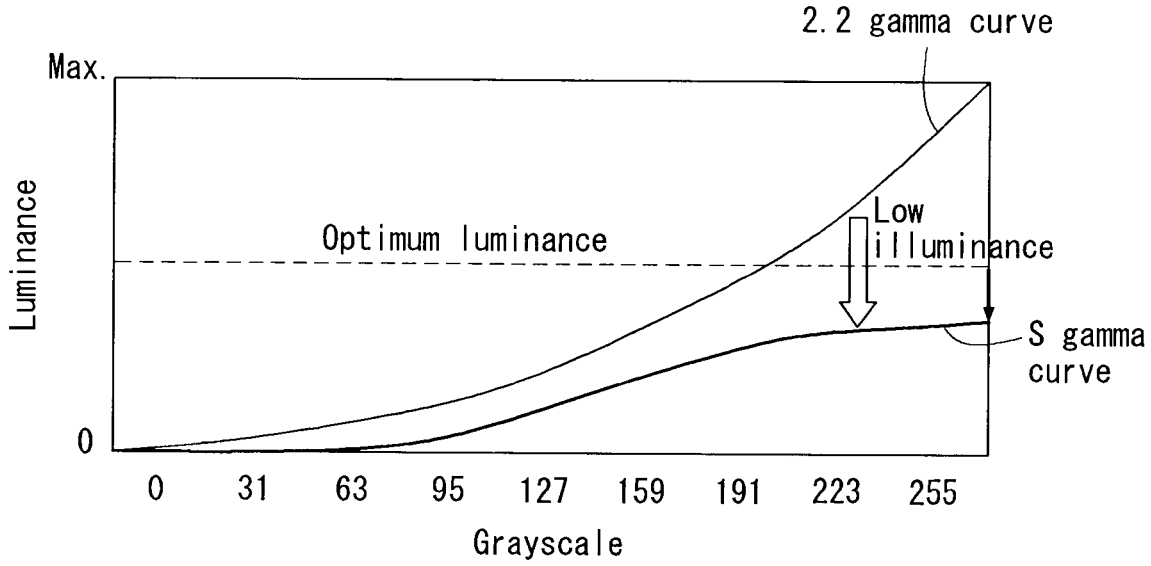
FIG. 9 illustrates a method for reducing a luminance of a display panel to be less than an optimum luminance at a low illuminance and adjusting the S gamma curve to compensate for a reduction in the luminance of the display panel.

As shown in FIG. 9, the gamma compensation method according to the embodiment of the invention reduces the luminance of the display panel to be less than the optimum luminance at the low illuminance to further reduce the power consumption, and also may modulate the gray levels of the data based on the S gamma curve, so as to compensate for a reduction in the image quality. The luminance of the display panel is set to be less than the optimum luminance, but has to be set to be greater than the minimum recognition luminance.

When the luminance of the display panel is further reduced to be equal to or less than the optimum luminance, the gamma compensation method according to the embodiment of the invention raises the S gamma curve by a reduction ratio of the luminance of the display panel as indicated by the Equation (4), thereby compensating for a reduction in the luminance of the display panel.

$$D_{out} = \begin{cases} a^{(1-\alpha)} D_{in}^{\alpha} \times \omega_1, & 0 \le D_{in} \le a \\ (255 - (255 - a)^{(1-\beta)}(255 - D_{in})^{\beta}) \times \omega_2, & a < D_{in} \le 255 \end{cases} \quad (4)$$

$$\text{where } \omega_1 = \left(\frac{L_1}{L_2}\right)^{\frac{1}{2.2}}, \ \omega_2 = \frac{1-\omega_1}{255-a}(D_{in} - 255) + 1$$

In Equation (4), '$L_1$' is the luminance of the display panel before the adjustment, and '$L_2$' is the luminance of the display panel after the adjustment.

Figure 10:
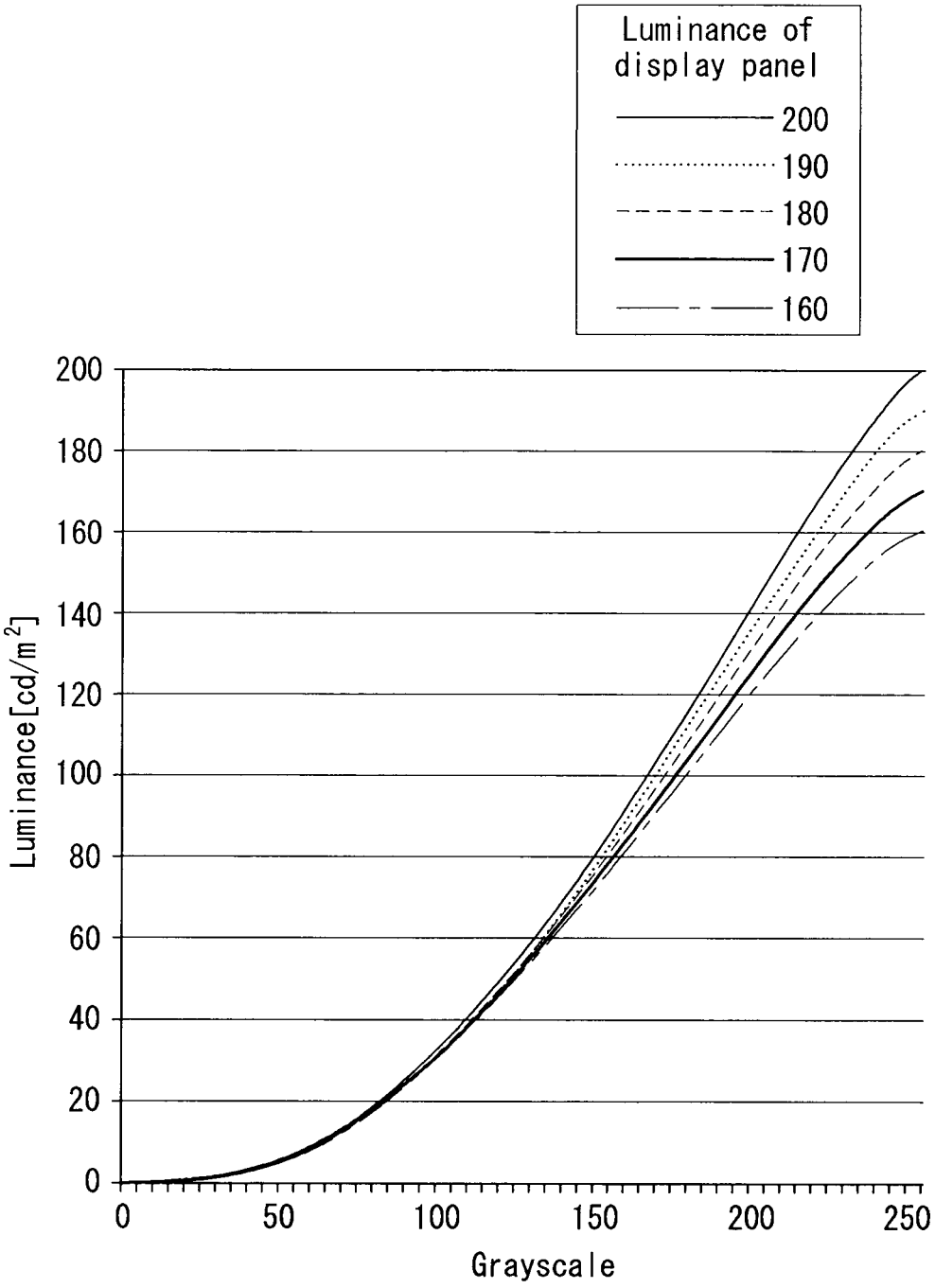
FIG. 10 illustrates changes in a S gamma curve based on changes in a luminance of a display panel.

When the luminance of the display panel is adjusted as shown in FIG. 10, the inflection point and a maximum value of the S gamma curve change. When the luminance of the display panel is reduced, the inflection point and the maximum value of the S gamma curve are reduced. As a result, the power consumption is reduced. In FIG. 10, "200", "190", "180", "170" and "160" are the luminances at the minimum gray level. As described above, the method for reducing the luminance of the display panel may be properly selected depending on the type of the display device. For example, in a liquid crystal display, the luminance of the display panel may be reduced by reducing the luminance of the backlight unit.

Figure 11:
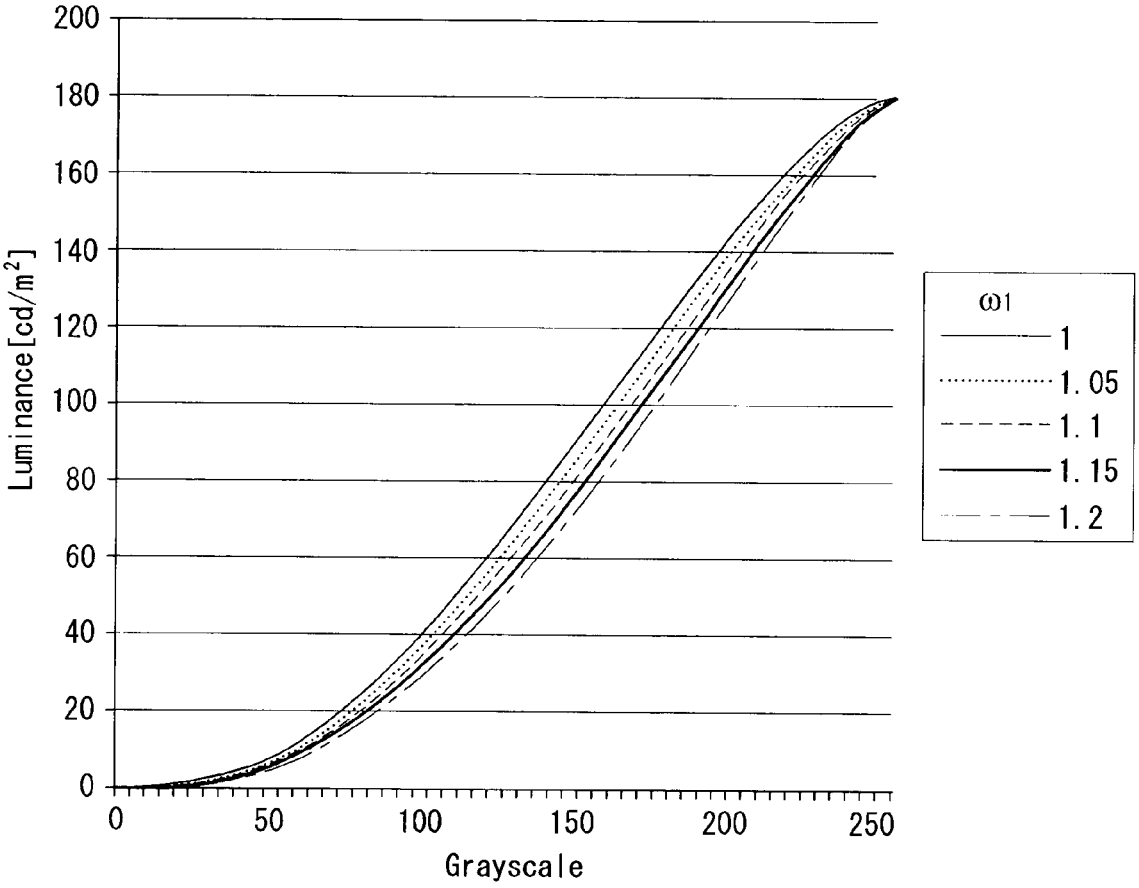
FIG. 11 illustrates an example where a luminance compensation variable of S gamma curve changes depending on a luminance of a display panel.

In Equation (4), 'ω1' is a luminance compensation variable for raising the inflection point of the S gamma curve toward a direction of the luminance axis by the reduction ratio of the luminance of the display panel. 'ω1' performs an exponential operation of (1/2.2) on the reduction ratio of the luminance of the display panel and converts an adjustment ratio of the luminance into a grayscale adjustment ratio of data. As '$L_2$' decreases, 'ωl' increases. Further, as 'ω1' increases, the inflection point 'a' of the S gamma curve rises along the luminance axis as shown in FIG. 11. 'ω2' is a variable determined by 'ω1' and causes the inflection point 'a' to coincide with a start point of the convex curve in the S gamma curve.

The S gamma curve defined by the above Equation (4) may be upward shifted by the offset value O as indicated by the Equation (5) below.

$$D_{out} = \begin{cases} (S \cdot a^{(1-\alpha)} D_{in}^{\alpha} + O) \times \omega_1, & 0 \le D_{in} \le a \\ (S \cdot (255 - (255 - a)^{(1-\beta)}(255 - D_{in})^{\beta}) + O) \times \omega_2, & a < D_{in} \le 255 \end{cases} \quad (5)$$

The gamma compensation method according to the embodiment of the invention differently adjusts the high gray level emphasis variable 'β' of the S gamma curve at each illuminance belonging to the low illuminance, thereby optimizing the representation of the high gray level and the luminance at each illuminance. When the low gray level emphasis variable 'α' is 1 and the inflection point 'a' is 55 at the low illuminance, the high gray level emphasis variable 'β' may be selected within the range of 1.3 to 1.4. When the external illuminance is 100 lx, 50 lx, and 0 lx, the high gray level emphasis variable 'β' is 1.34, 1.33, and 1.36, respectively. In this instance, the representation of the high gray level and the luminance at each illuminance may be optimized. The high gray level emphasis variable 'β' of each illuminance is not limited to the above values. For example, the high gray level emphasis variable 'β' of each illuminance may vary depending on the low gray level emphasis variable 'α', the inflection point 'a', the luminance and the driving characteristic of the display panel.

Figure 12:
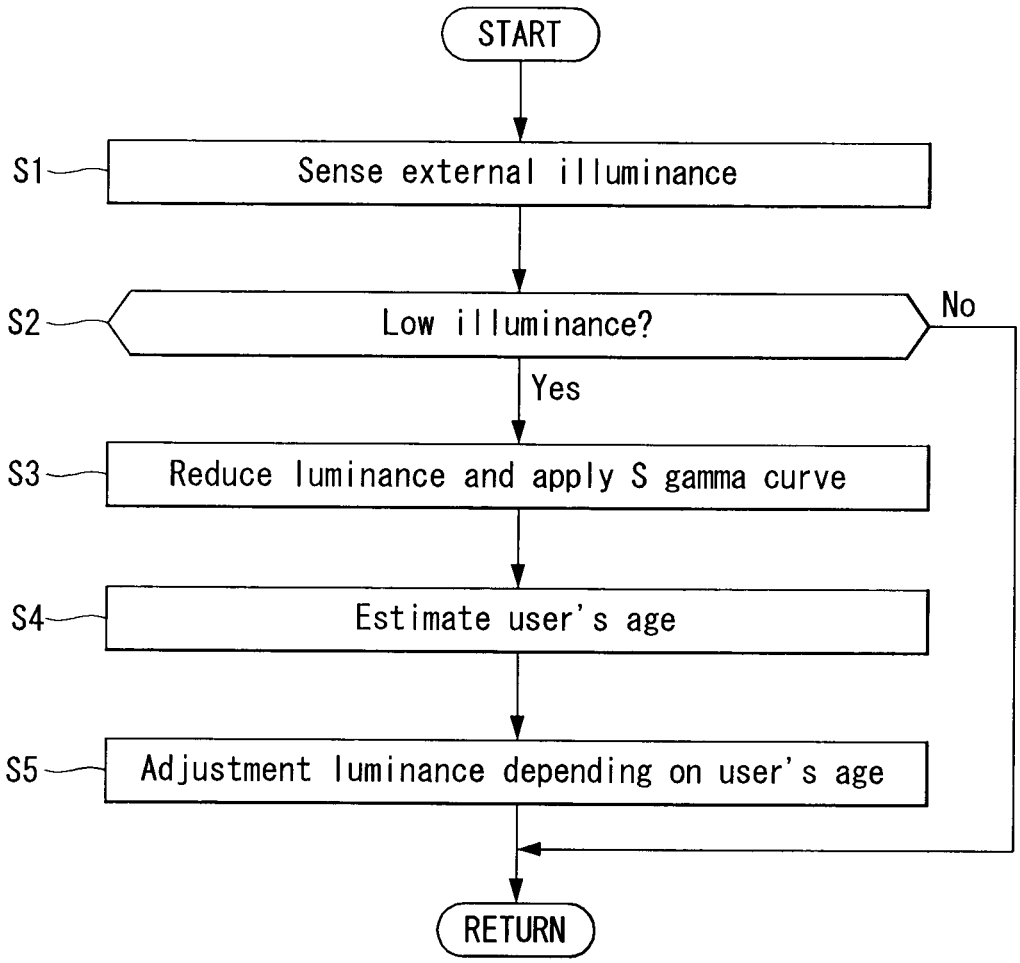
FIG. 12 is a flow chart showing a gamma compensation method according to a second embodiment of the invention.

FIG. 12 is a flow chart showing a gamma compensation method according to a second embodiment of the invention.

As shown in FIG. 12, the gamma compensation method according to the second embodiment of the invention reduces a luminance of a display panel to be equal to or less than an optimum level when an external illuminance is a low illuminance, estimates the user's age, and differently applies the luminance of the display panel depending on the user's age. Since steps S1 to S3 in the second embodiment of the invention are substantially the same as the first embodiment of the invention, a further description may be briefly made or may be entirely omitted. The step S3 is to modulate input data at the low illuminance based on S gamma curve.

Figures 13, 14:
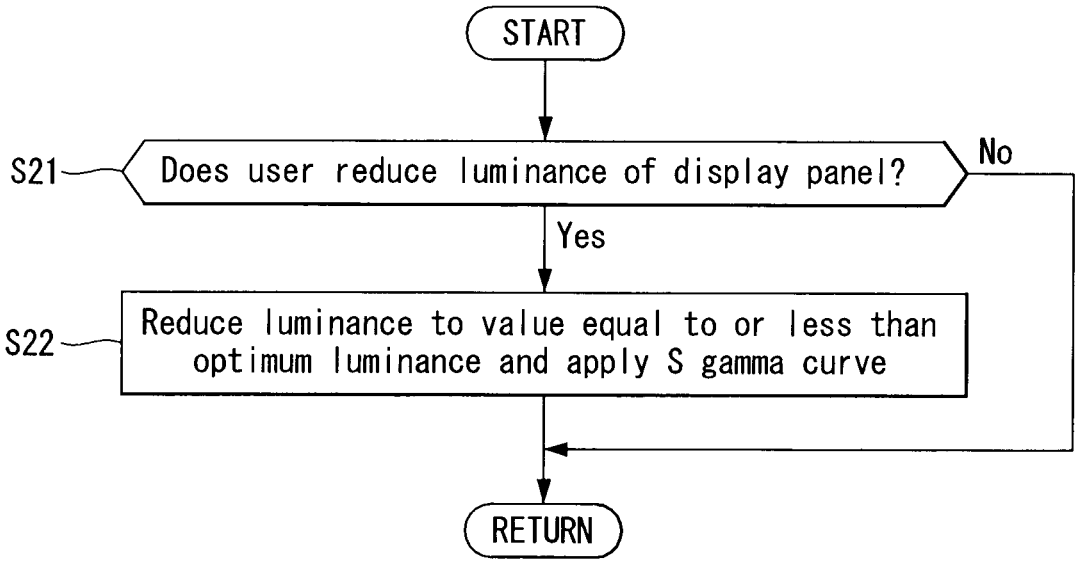
FIG. 13 is a table of diameters of a user's pupil based upon age.
FIG. 14 is a flow chart showing a gamma compensation method according to a third embodiment of the invention.

The gamma compensation method according to the second embodiment of the invention analyzes an image taken with an image sensor, for example, a camera and estimates the user's age in step S4. As shown in FIG. 13, the sizes of pupils of people tend to be different depending on the age. A user estimate algorithm calculates the size of the user's pupil and may estimate the user's age. In FIG. 13, "Photopic pupil diameter" indicates a diameter of the pupil at the illuminance of a bright environment, and "Scotopic pupil diameter" indicates a diameter of the pupil in the darkroom.

The gamma compensation method according to the second embodiment of the invention reduces the luminance of the display device to be equal to or less than an optimum luminance at the low illuminance irrespective of the user's age and also controls the luminance of the display device to be greater than a minimum recognition luminance. As the user's age is lowered, the user can easily recognize the low gray level even if the luminance of the display panel is reduced. On the other hand, it is generally more difficult for older-age person to recognize the low gray level when the luminance of the display panel is reduced. Thus, considering the user's age, the gamma compensation method according to the second embodiment of the invention causes the luminance of the display panel for the older user (for example, the user aged 60 or older) to be greater than the luminance of the display panel for the young user (for example, the user under the age of 60). On the other hand, the gamma compensation method according to the second embodiment of the invention greatly reduces the luminance of the display panel at the low illuminance when the user's age is lowered, thereby increasing an improvement effect of the power consumption. Thus, the gamma compensation method according to the second embodiment of the invention reduces the luminance of the display panel, so as to increase the improvement effect of the power consumption at the low illuminance. However, in this instance, the gamma compensation method according to the second embodiment of the invention varies an adjustment width of the luminance of the display panel in consideration of recognition characteristics depending on the user's age in step S5, so that the user scarcely feels a reduction in the image quality irrespective of the age.

As described above, the gamma compensation method according to the second embodiment of the invention may analyze the image obtained by the image sensor to estimate the user's age, but is not limited thereto. For example, the gamma compensation method according to the second embodiment of the invention may control the luminance and the gamma compensation based on the user's age input through a user interface. As described above, when the user's age is received from the user through a user interface, the gamma compensation method according to the second embodiment of the invention may greatly reduce the luminance of the display panel at the low illuminance if the user is a young person, thereby increasing the improvement effect of the power consumption. On the other hand, if the user's age input through the user interface is high, the gamma compensation method according to the second embodiment of the invention may slightly reduce the luminance of the display panel.

The optimum luminance may be set within the range of 6.5 nit to 25 nit. If the user is a younger person (for example, the user is between the ages of 10 and 40) with relatively good eyesight, the optimum luminance may be set to a minimum luminance, i.e., 6.5 nit. On the other hand, if the user is an older person (for example, the user between the ages of 60 and 70) with relatively poor eyesight, the optimum luminance may be set to a maximum luminance, i.e., 255 nit. If the user's age ranges from 40 to 60, the optimum luminance may be set to the luminance between 6.5 nit and 25 nit.

As described above, the luminance of the display device may vary depending on the external illuminance and also may be adjusted by the user irrespective of the external illuminance.

FIG. 14 is a flow chart showing a gamma compensation method according to a third embodiment of the invention.

Figure 15:
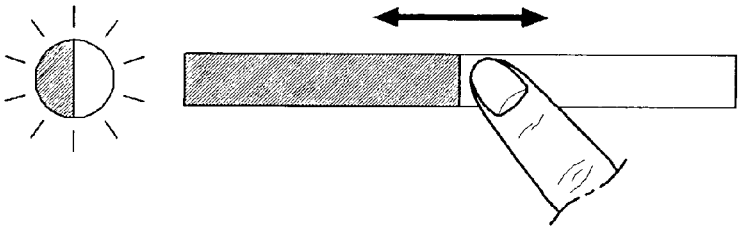
FIG. 15 illustrates an example where a luminance of a display panel in a hand device changes through a touch user interface.

As shown in FIG. 14, the gamma compensation method according to the third embodiment of the invention reduces a luminance of a display panel to be equal to or less than a previously determined optimum luminance when the luminance of the display panel is reduced by the user, and applies S-curve gamma compensation method in steps S1 and S2. The gamma compensation method according to the third embodiment of the invention may be applied to a display device, in which the luminance of the display panel is adjusted by the user irrespective of an external illuminance, or a hand device not having an illuminance sensor for sensing the external illuminance. As shown in FIG. 15, the user may reduce a luminance of a display panel of the hand device through, for example, a touch user interface.

Even if the user reduces the luminance of the display panel to a minimum value, the gamma compensation method according to the third embodiment of the invention may limit a reduction width of the luminance of the display panel, so that the luminance of the display panel is not reduced to the luminance equal to or less than a minimum recognition luminance.

Figure 16:
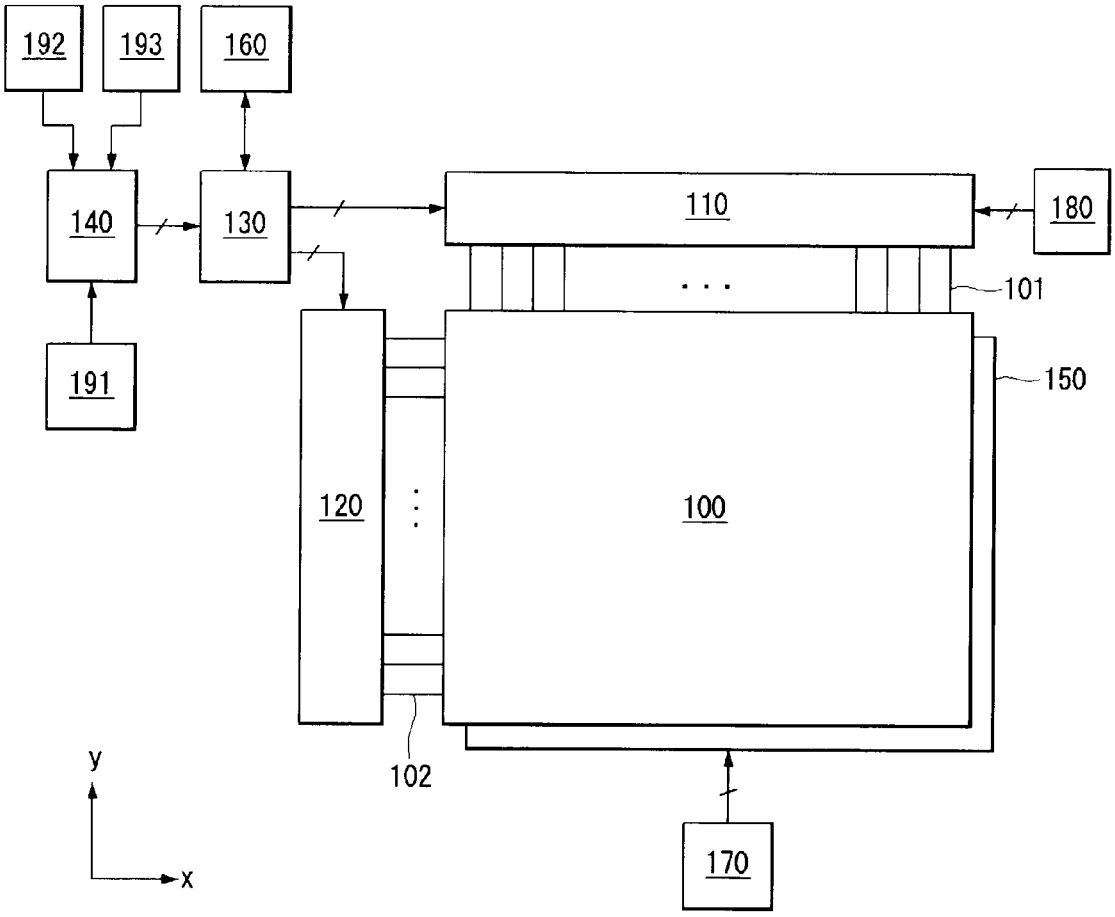
FIG. 16 illustrates a display device according to an exemplary embodiment of the invention.
Figure 17:
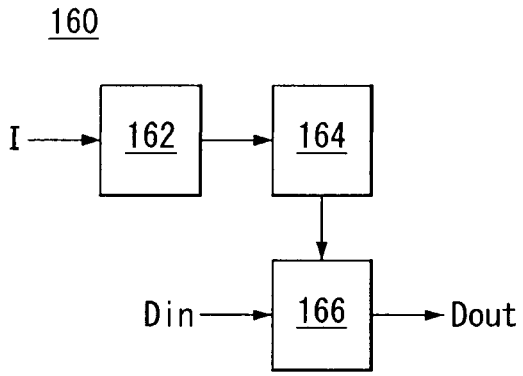
FIG. 17 illustrates a gamma compensation unit shown in FIG. 16.
Figure 18:
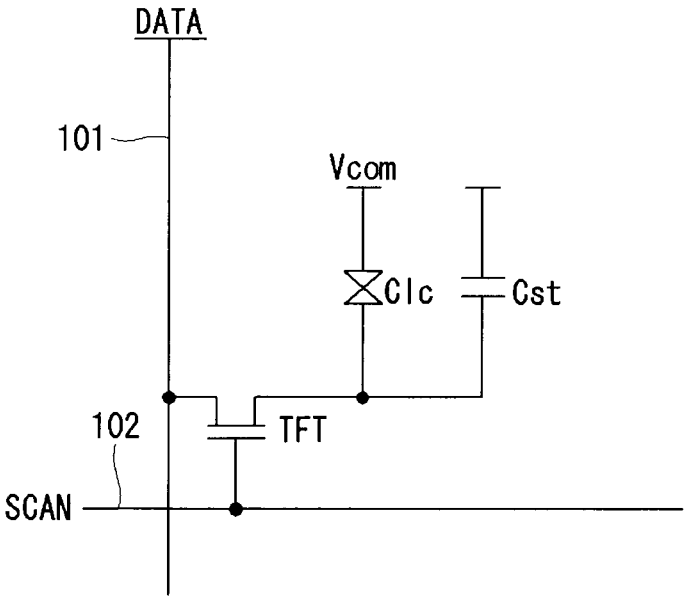
FIG. 18 is an equivalent circuit diagram showing a pixel of a liquid crystal display.
Figure 19:
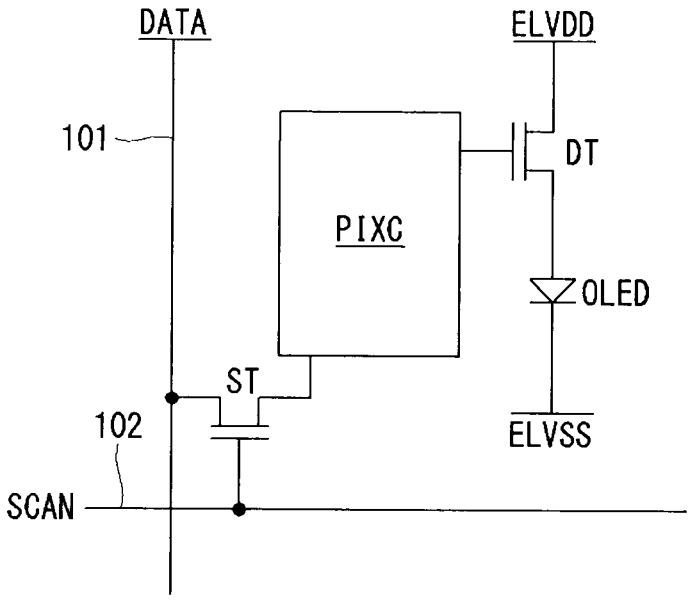
FIG. 19 is an equivalent circuit diagram showing a pixel of an organic light emitting display.

FIG. 16 illustrates a display device according to an embodiment of the invention. FIG. 17 illustrates a gamma compensation unit shown in FIG. 16. FIG. 18 is an equivalent circuit diagram showing a pixel of a liquid crystal display. FIG. 19 is an equivalent circuit diagram showing a pixel of an organic light emitting display.

As shown in FIGS. 16 to 19, the display device according to an embodiment of the invention includes a display panel 100, a display panel drivers, a sensor, and the like.

Data lines 101, gate lines (or scan lines) 102 crossing the data lines 101, and pixels arranged in a matrix form are formed on the display panel 100.

As shown in FIG. 18, in the liquid crystal display, each pixel includes a liquid crystal cell Clc, a storage capacitor Cst, a thin film transistor (TFT), and the like. The liquid crystal cell Clc delays a phase of light using liquid crystal molecules driven by an electric field between a pixel electrode, to which a data voltage DATA is applied through the TFT, and a common electrode, to which a common voltage Vcom is applied, thereby adjusting a transmittance depending on data. The storage capacitor Cst holds a voltage of the liquid crystal cell Clc during one frame period. The TFT is turned on in response to a gate pulse (or scan pulse) SCAN from the gate line 102 and supplies the data voltage DATA from the data line 101 to the pixel electrode of the liquid crystal cell Clc. The liquid crystal display may be implemented in any known liquid crystal mode, such as a twisted nematic (TN) mode, a vertical alignment (VA) mode, an in-plane switching (IPS) mode, and a fringe field switching (FFS) mode. Further, the liquid crystal display may be implemented as various types including a transmissive liquid crystal display, a transflective liquid crystal display, a reflective liquid crystal display, etc. The transmissive liquid crystal display and the transflective liquid crystal display include a backlight unit 150 and a backlight driver 170.

The backlight unit 150 may be implemented as a direct type backlight unit or an edge type backlight unit. The backlight unit 150 is disposed under a bottom surface of the display panel 100 of the liquid crystal display and irradiates light onto the display panel 100. The backlight driver 170 supplies a current to light sources of the backlight unit 150 and causes the light sources to emit light. The light sources may be implemented as a light emitting diode (LED). When the external illuminance is reduced to the level of the darkroom or the user wants to reduce a luminance of the display panel 100, the backlight driver 170 reduces a luminance of the light sources under the control of a host system 140 or a timing controller 130, so as to reduce a luminance of all of the pixels. The backlight driver 170 may differently apply a reduction width of the luminance of the light sources depending on the user's age under the control of the host system 140 or the timing controller 130. The backlight driver 170 may adjust the luminance of the light sources using pulse width modulation (PWM) control.

As shown in FIG. 19, in the organic light emitting display, each pixel includes a switching TFT ST, a compensation circuit PIXC, a driving TFT DT, an organic light emitting diode (OLED), and the like. The switching TFT ST supplies the data voltage DATA to the compensation circuit PIXC in response to the gate pulse SCAN. The compensation circuit PIXC includes at least one switching TFT and at least one capacitor. The compensation circuit PIXC initializes a gate of the driving TFT DT and then senses a threshold voltage of the driving TFT DT. The compensation circuit PIXC adds the threshold voltage of the driving TFT DT to the data voltage DATA and thus compensates for the data voltage DATA. The compensation circuit PIXC may use any known compensation circuit. The driving TFT DT is connected between a high potential power voltage line, to which a high potential power voltage ELVDD is supplied, and the OLED and adjusts a current flowing in the OLED depending on the voltage applied to the gate of the driving TFT DT. The OLED has a stack structure of organic compound layers including a hole injection layer HIL, a hole transport layer HTL, a light emitting layer EML, an electron transport layer ETL, an electron injection layer EIL, etc. The OLED generates light when electrons and holes are combined in the light emitting layer EML.

When the external illuminance is the low illuminance or the user wants to reduce a luminance, the organic light emitting display reduces the high potential power voltage ELVDD, thereby reducing the luminance. Further, the organic light emitting display may reduce the luminance by reducing a gamma reference voltage supplied to a data driving circuit 110. The organic light emitting display may differently adjust an adjustment width of a luminance of light sources depending on the user's age.

The display panel driver writes data on the pixels of the display panel 100. When the external illuminance is the low illuminance or the luminance of the display panel 100 is compulsively reduced by the user, the display panel driver modulates data of the input image, which will be written on the pixels, using the S gamma curve. On the other hand, when the external illuminance is high and the luminance of the display panel 100 is not compulsively reduced by the user, the display panel driver modulates data of the input image using the existing 2.2 gamma curve. The display panel driver includes the data driving circuit 110, a gate driving circuit 120, the timing controller 130, a gamma reference voltage generator 180, a gamma compensation unit 160, and the like.

The data driving circuit 110 converts digital video data received from the timing controller 130 into gamma compensation voltages to generate the data voltages and supplies the data voltages to the data lines 101 of the display panel 100. The gamma reference voltage generator 180 supplies the gamma reference voltage to the data driving circuit 110. The gamma reference voltage is divided into the gamma compensation voltage of each gray level in the data driving circuit 110. The gate driving circuit 120 supplies a gate pulse synchronized with the data voltage supplied to the data lines 101 to the gate lines 102 of the display panel 100 under the control of the timing controller 130 and sequentially shifts the gate pulse.

When the external illuminance is a low illuminance or the user wants to reduce the luminance of the display panel 100, the gamma reference voltage generator 180 may reduce the gamma reference voltage under the control of the host system 140 or the timing controller 130.

The timing controller 130 supplies the digital video data received from the host system 140 to the gamma compensation unit 160 and supplies data modulated by the gamma compensation unit 160 to the data driving circuit 110. The timing controller 130 receives timing signals, such as a vertical sync signal, a horizontal sync signal, a data enable signal, and a main clock which are synchronized with the digital video data, from the host system 140. The timing controller 130 controls operation timings of the data driving circuit 110 and the gate driving circuit 120 using the timing signals received from the host system 140.

When the external illuminance is a low illuminance or the user wants to reduce the luminance of the display panel 100, the gamma compensation unit 160 modulates the digital video data of the input image using the disclosed S gamma curve of the invention. On the other hand, when the luminance of the display panel 100 is greater than the optimum luminance, the gamma compensation unit 160 modulates the digital video data of the input image using the existing 2.2 gamma curve.

As shown in FIG. 17, the gamma compensation unit 160 includes a lookup table selection unit 162, a plurality of lookup tables 164, and a data modulation unit 166. The gamma compensation unit 160 may be embedded in the host system 140 or the timing controller 130.

The lookup table selection unit 162 receives a sensor signal 'I' from an illuminance sensor 192, an image sensor 193, etc. The lookup table selection unit 162 selects one of the plurality of lookup tables 164 and transmits the selected lookup table information to the data modulation unit 166. For example, when the external illuminance is high, the lookup table selection unit 162 selects a first lookup table, in which data of the 2.2 gamma curve is previously set. Further, when the external illuminance is low, the lookup table selection unit 162 selects a second lookup table, in which data of the S gamma curve is previously set. The data modulation unit 166 modulates gray levels of input data based on a gamma compensation curve of the selected lookup table and transmits the modulated gray levels of input data to the data driving circuit 110 through the timing controller 130.

The host system 140 may be one of a television system, a set-top box, a navigation system, a DVD player, a Blu-ray player, a personal computer (PC), a home theater system, and a phone system. The host system 140 converts a resolution of the digital video data in conformity with a resolution of the display panel 100 using a scaler and transmits the converted digital video data and the timing signals to the timing controller 130.

A user interface 191, the illuminance sensor 192, and the image sensor 193 may be connected to the host system 140. The user interface 191 may be implemented as a keypad, a keyboard, a mouse, an on-screen display (OSD), a remote controller, a graphic user interface, (GUI), a touch UI, a voice recognition UI, a 3D UI, etc. The user may input a command for reducing the luminance of the display panel 100 to the host system 140 through the user interface 191. The host system 140 may reduce the luminance of the display panel 100 depending on the external illuminance sensed by the illuminance sensor 192, or may reduce the luminance of the display panel 100 in response to the user's command input through the user interface 191. Further, the host system 140 may analyze an image input through the image sensor 193, for example, a camera to estimate the user's age and may differently control the adjustment width of the luminance of the display panel 100 depending on the estimated user's age. The method for adjusting the luminance of the display panel 100 and the gamma compensation method may be controlled by the timing controller 130.

The display device according to the embodiments of the invention controls a luminance adjusting unit based on the above-described gamma compensation methods to adjust the luminance of the display panel. The luminance adjusting unit is controlled by the host system 140 or the timing controller 130. The luminance adjusting unit varies at least one of the backlight luminance, the gamma reference voltage, the high potential power voltage ELVDD, sustain pulses of the plasma display panel, and an anode voltage of the field emission display under a control of the host system 140 or the timing controller 130. The luminance adjusting unit operates in synchronization with the gamma compensation unit 160.

As described above, the embodiments of the invention compensate for a reduction in the grayscale representation through the S gamma compensation method when the luminance of the display panel is reduced, and also raises the S gamma curve by the reduction ratio of the luminance of the display panel to compensate for a reduction in the luminance of the display panel. As a result, the embodiments of the invention may minimize a reduction in the image quality when the luminance of the display panel is reduced, and may reduce the power consumption.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gamma compensation method for a display device, comprising:

sensing a level of external illuminance;

determining whether the sensed level of external illuminance is equal to or lower than a predetermined illuminance, wherein when the sensed level is equal to or lower than the predetermined illuminance, the luminance of the display device is reduced to an optimum luminance; and modulating gray levels of input data of the display device based on a first gamma curve when the sensed level of external illuminance is equal to or lower than the predetermined illuminance, and modulating based on a second gamma curve when the sensed level of external illuminance is greater than the predetermined illuminance, wherein the first gamma curve includes a concave curve set in a low gray level area and a convex curve set in a high gray level area, and the concave curve and the convex curve are connected via an inflection point, and wherein the first gamma curve is defined by the following equation:

$$D_{out} = \begin{cases} a^{(1-\alpha)} D_{in}^{\alpha}, & 0 \le D_{in} \le a \\ 255 - (255 - a)^{(1-\beta)}(255 - D_{in})^{\beta}, & a < D_{in} \le 255 \end{cases}$$

where 'Din' is data of the input image, 'Dout' is output data which will be written to the pixels of the display device, 'a' is the inflection point between the concave curve and the convex curve, 'α' is a low gray level emphasis variable, and 'β' is a high gray level emphasis variable.

2. The gamma compensation method of claim 1, wherein the optimum luminance is 6.5 cd/m$^2$-25 cd/m2.

3. The gamma compensation method of claim 1, wherein the concave curve defines gray levels in the low gray level area, 0≤Din≤a, and wherein the convex curve defines gray levels in the high gray level, a≤Din≤255.

4. The gamma compensation method of claim 1, wherein the second gamma curve is a 2.2 gamma curve and defined by the following equation:

$$D_{out} = 255 \cdot \left(\frac{D_{in}}{255}\right)^{2.2}.$$

5. The gamma compensation method of claim 4, wherein the 2.2 gamma curve is implemented by a first lookup table.

6. The gamma compensation method of claim 1, wherein the first gamma curve is defined by the following equation:

$$D_{out} = \begin{cases} a^{(1-\alpha)} D_{in}^{\alpha}, & 0 \le D_{in} \le a \\ 255 - (255 - a)^{(1-\beta)}(255 - D_{in})^{\beta}, & a < D_{in} \le 255 \end{cases}$$

where 'α' is a low gray level emphasis variable, 'β' is a high gray level emphasis variable, 'S' is a slope, and 'O' is an offset.

7. The gamma compensation method of claim 1, further comprising, when the luminance of the display panel is reduced to be equal to or less than the optimum luminance, raising the first gamma curve by a reduction ratio of the luminance of the display device.

8. The gamma compensation method of claim 7, wherein the first gamma curve is defined by the following equation:

$$D_{out} = \begin{cases} a^{(1-\alpha)} D_{in}^{\alpha}, & 0 \le D_{in} \le a \\ 255 - (255 - a)^{(1-\beta)}(255 - D_{in})^{\beta}, & a < D_{in} \le 255 \end{cases}$$

$$\omega_1 = \left(\frac{L_1}{L_2}\right)^{\frac{1}{2.2}}, \ \omega_2 = \frac{1 - \omega_1}{255 - a}(D_{in} - 255) + 1$$

where 'α' is a low gray level emphasis variable, 'β' is a high gray level emphasis variable, 'L1' is a luminance of the display panel before the adjustment, and 'L2' is a luminance of the display device after the adjustment.

9. The gamma compensation method of claim 7, wherein the first gamma curve is defined by the following equation:

$$D_{out} = \begin{cases} (S \cdot a^{(1-\alpha)} D_{in}^{\alpha} + O) \times \omega_1, & 0 \le D_{in} \le a \\ (S \cdot (255 - (255 - a)^{(1-\beta)}(255 - D_{in})^{\beta}) + O) \times \omega_2, & a < D_{in} \le 255 \end{cases}$$

$$\omega_1 = \left(\frac{L_1}{L_2}\right)^{\frac{1}{2.2}}, \ \omega_2 = \frac{1 - \omega_1}{255 - a}(D_{in} - 255) + 1$$

where 'α' is a low gray level emphasis variable, 'β' is a high gray level emphasis variable, '$L_1$' is a luminance of the display panel before the adjustment, '$L_2$' is a luminance of the display panel after the adjustment, 'S' is a slope, and 'O' is an offset.

10. The gamma compensation method of claim 9, further comprising:

controlling a reduction width of the luminance of the display device based upon an age of the user, wherein the reduction width of an older user is less than a reduction width of a younger user.

11. The gamma compensation method of claim 10, further comprising estimating a user's age using an image sensor or deciding the user's age in response to user data input through a user interface.

12. The gamma compensation method of claim 1, further comprising reducing the luminance of the display device in response to user data input through a user interface.

13. A display device comprising:

a display panel driver arranged to modulate gray levels of input image data, which will be written to pixels of a display panel, based on a first gamma curve when a luminance of a display panel is reduced to be equal to or less than a previously determined optimum luminance, and modulate the gray levels of input image data based upon a second gamma curve when the luminance of the display panel is greater than the optimum luminance, wherein the first gamma curve includes a concave curve set in a low gray level area and a convex curve set in a high gray level area, and the concave curve and the convex curve are connected via an inflection point, and wherein the first gamma curve is defined by the following equation:

$$D_{out} = \begin{cases} a^{(1-\alpha)} D_{in}^{\alpha}, & 0 \le D_{in} \le a \\ 255 - (255 - a)^{(1-\beta)}(255 - D_{in})^{\beta}, & a < D_{in} \le 255 \end{cases}$$

where 'Din' is data of the input image, 'Dout' is output data which will be written to the pixels of the display device, 'a' is the inflection point between the concave curve and the convex curve, 'α' is a low gray level emphasis variable, and 'β' is a high gray level emphasis variable.

14. The display device of claim 13, wherein the optimum luminance is 6.5 cd/m$^2$-25 cd/m$^2$.

15. The display device of claim 13, wherein the second gamma curve is defined by the following equation:

$$D_{out} = 255 \cdot \left(\frac{D_{in}}{255}\right)^{2.2}.$$

16. The display device of claim 15, wherein the display panel driver raises the first gamma curve by a reduction ratio of the luminance of the display panel when the luminance of the display panel is reduced to be equal to or less than the optimum luminance.

17. The display device of claim 16, further comprising:

an illuminance sensor arranged to sense an external illuminance around the display panel; and a luminance adjusting unit arranged to reduce the luminance of the display panel when the external illuminance is a low illuminance having a previously determined level.

18. The display device of claim 17, wherein the luminance adjusting unit differently applies the convex curve of the first gamma curve at each illuminance belonging to the low illuminance.

19. The display device of claim 17, further comprising an image sensor, wherein the luminance adjusting unit estimates a user's age based on an image obtained by the image sensor or decides the user's age in response to user data input through a user interface to differently control a reduction width of the luminance of the display panel based on the user's age, and wherein the reduction width of an older user is less than the reduction width of a younger user.

* * * * *